US008678650B2

(12) United States Patent
Savage

(10) Patent No.: US 8,678,650 B2
(45) Date of Patent: Mar. 25, 2014

(54) FLEXIBLE PACKAGE AND METHOD THEREOF

(76) Inventor: Danielle Z. Savage, Asbury Park, NJ (US)

( * ) Notice: Subject to any disclaimer, the term of this patent is extended or adjusted under 35 U.S.C. 154(b) by 595 days.

(21) Appl. No.: 12/401,063

(22) Filed: Mar. 10, 2009

(65) Prior Publication Data

US 2010/0230407 A1 Sep. 16, 2010

(51) Int. Cl.
*B65D 33/00* (2006.01)

(52) U.S. Cl.
USPC ..... 383/33; 383/35; 383/68; 220/9.4

(58) Field of Classification Search
USPC ..... 383/33, 34, 35, 200, 68; 220/9.4
See application file for complete search history.

(56) References Cited

U.S. PATENT DOCUMENTS

| | | | | | |
|---|---|---|---|---|---|
| 1,138,882 | A | * | 5/1915 | Meier | 150/150 |
| 1,281,038 | A | * | 10/1918 | McGhee | 229/405 |
| 1,463,113 | A | * | 7/1923 | Bibb | 383/43 |
| 1,658,294 | A | * | 2/1928 | Lewis | 150/150 |
| 2,008,314 | A | * | 7/1935 | Russell | 24/30.5 R |
| 2,080,402 | A | * | 5/1937 | Herman | 206/260 |
| 2,084,757 | A | * | 6/1937 | Isador | 383/34 |
| 2,142,904 | A | * | 1/1939 | Lamarthe | 24/30.5 R |
| 2,150,627 | A | * | 3/1939 | Lieber | 383/34 |
| 2,158,955 | A | | 5/1939 | Blacher | |
| 2,227,390 | A | * | 12/1940 | Green | 383/34 |
| 2,903,033 | A | * | 9/1959 | Robinson | 190/122 |
| 3,259,302 | A | | 7/1966 | Rocchisani | |
| 3,384,938 | A | * | 5/1968 | O'Connor | 24/461 |
| 3,406,853 | A | * | 10/1968 | McLeod | 215/11.3 |
| 3,437,258 | A | | 4/1969 | Kugler | |
| 3,473,532 | A | * | 10/1969 | Eisenberg | 604/262 |
| 3,845,897 | A | | 11/1974 | Buttery et al. | |
| 3,877,632 | A | | 4/1975 | Steel | |
| 3,905,406 | A | * | 9/1975 | Cruse | 141/390 |
| 4,069,994 | A | * | 1/1978 | Wharmby | 248/101 |
| 4,356,600 | A | | 11/1982 | Welch | |
| 4,509,231 | A | | 4/1985 | Paxton | |
| 4,541,117 | A | * | 9/1985 | Ashbeck | 383/64 |
| 4,836,690 | A | * | 6/1989 | Cheng | 383/6 |
| 4,846,427 | A | * | 7/1989 | Jones | 248/95 |
| 4,898,477 | A | * | 2/1990 | Cox et al. | 383/33 |
| 4,901,885 | A | | 2/1990 | Boots | |
| 4,927,037 | A | | 5/1990 | Boots | |
| 4,948,266 | A | * | 8/1990 | Bencic | 383/34 |
| 4,978,025 | A | | 12/1990 | Fougeres | |

(Continued)

FOREIGN PATENT DOCUMENTS

| | | |
|---|---|---|
| NZ | 245446 | 7/1995 |
| WO | WO 01/21497 A1 | 3/2001 |
| WO | WO 03/066457 A2 | 8/2003 |

*Primary Examiner* — Jes F Pascua
*Assistant Examiner* — Peter Helvey
(74) *Attorney, Agent, or Firm* — Kacvinsky Daisak Bluni PLLC

(57) ABSTRACT

An improved flexible package and method thereof are disclosed herein. In accordance with one embodiment of the present invention, a package system comprises a flexible package having at least a front wall, a back wall, a top wall, a bottom wall, and a plurality of side walls; and a locking means for maintaining a portion of the flexible package in a predetermined position, the locking means cooperating with at least a portion of the flexible package and comprising at least one semi-rigid member; wherein one of the front wall, the back wall, the top wall, the bottom wall, or any of the plurality of side walls has a substantially negligible surface area.

20 Claims, 12 Drawing Sheets

(56) References Cited

U.S. PATENT DOCUMENTS

| | | | | | |
|---|---|---|---|---|---|
| 5,000,500 | A * | 3/1991 | Almog | 294/1.3 |
| 5,009,236 | A * | 4/1991 | Brothers | 600/574 |
| 5,033,780 | A * | 7/1991 | Wootten | 294/1.3 |
| 5,037,138 | A * | 8/1991 | McClintock et al. | 383/34 |
| 5,044,774 | A * | 9/1991 | Bullard et al. | 383/34.1 |
| 5,054,168 | A * | 10/1991 | Gandy et al. | 24/30.5 R |
| 5,174,658 | A | 12/1992 | Cook et al. | |
| 5,184,896 | A * | 2/1993 | Hammond et al. | 383/33 |
| 5,289,937 | A | 3/1994 | Boots | |
| D359,220 | S | 6/1995 | Vinar | |
| 5,451,107 | A * | 9/1995 | Ricker | 383/10 |
| 5,609,419 | A * | 3/1997 | Byers, Jr. | 383/33 |
| 5,615,853 | A * | 4/1997 | Hearst | 248/99 |
| 5,622,431 | A * | 4/1997 | Simonsen | 383/63 |
| 5,647,670 | A * | 7/1997 | Iscovich | 383/33 |
| 5,716,138 | A | 2/1998 | Southwell | |
| 5,738,444 | A * | 4/1998 | Lantz et al. | 383/68 |
| 5,802,677 | A | 9/1998 | Dorman et al. | |
| 5,931,117 | A * | 8/1999 | Lantz et al. | 119/65 |
| 5,967,357 | A | 10/1999 | Kellogg et al. | |
| 6,045,263 | A * | 4/2000 | Keller et al. | 383/33 |
| 6,139,187 | A * | 10/2000 | Galomb et al. | 383/81 |
| 6,164,821 | A * | 12/2000 | Randall | 383/34 |
| 6,182,890 | B1 | 2/2001 | Sattler et al. | |
| 6,234,674 | B1 * | 5/2001 | Byers, Jr. | 383/33 |
| 6,290,392 | B1 | 9/2001 | Sandor | |
| 6,325,541 | B1 | 12/2001 | Thrall et al. | |
| 6,345,911 | B1 * | 2/2002 | Young et al. | 383/6 |
| 6,361,210 | B2 * | 3/2002 | Denko | 383/35 |
| 6,371,642 | B1 * | 4/2002 | Nelson et al. | 383/23 |
| 6,419,153 | B1 | 7/2002 | Maita | |
| 6,494,619 | B1 * | 12/2002 | Sulpizio | 383/33 |
| 6,508,587 | B1 * | 1/2003 | Byers, Jr. | 383/33 |
| 6,554,810 | B1 * | 4/2003 | Wilk et al. | 604/323 |
| 6,572,267 | B1 * | 6/2003 | Forman | 383/61.2 |
| 6,827,491 | B2 * | 12/2004 | Kohl et al. | 383/64 |
| 6,886,982 | B2 * | 5/2005 | Reynolds | 383/68 |
| 6,899,460 | B2 * | 5/2005 | Turvey et al. | 383/33 |
| 6,904,647 | B2 * | 6/2005 | Byers, Jr. | 24/30.5 R |
| 6,921,204 | B2 | 7/2005 | Edwards et al. | |
| 6,939,042 | B2 * | 9/2005 | Rusnak et al. | 383/71 |
| 7,104,293 | B2 * | 9/2006 | Lais et al. | 141/302 |
| 7,300,207 | B2 * | 11/2007 | Linneweil | 383/35 |
| 7,347,623 | B2 * | 3/2008 | Cawley | 383/33 |
| 7,416,337 | B2 * | 8/2008 | Munch-Fals | 383/34 |
| 2001/0026650 | A1 * | 10/2001 | Denko | 383/60 |
| 2002/0154835 | A1 * | 10/2002 | Galomb | 383/10 |
| 2005/0276523 | A1 * | 12/2005 | Munch-Fals | 383/34 |
| 2005/0281488 | A1 * | 12/2005 | Cawley | 383/33 |
| 2006/0013512 | A1 * | 1/2006 | Shaw | 383/5 |
| 2009/0050655 | A1 | 2/2009 | Ianna et al. | |
| 2010/0230407 | A1 * | 9/2010 | Savage | 220/9.4 |
| 2011/0188785 | A1 * | 8/2011 | Turvey et al. | 383/34 |

* cited by examiner

FLEXIBLE PACKAGE AND METHOD THEREOF

BACKGROUND

1. Field of the Invention

Embodiments of the present invention generally relate to improved flexible packaging and a method thereof. More specifically, embodiments of the present invention relate to a flexible package having at least a semi-rigid portion for retaining the package in a substantially open position, and a method thereof.

2. Description of the Related Art

Each year, many millions of people around the world visit fast food restaurants on six out of the seven continents. Typically, these fast food restaurants are patronized by people who desire to eat a quick meal while en route between their origin and their destination, or by people who desire a break from preparing a home-cooked meal. Due to their convenience and ubiquity, it is estimated people in the United States alone spend about $150 billion per year at fast food restaurants.

Although many modern fast food restaurants provide indoor seating for their patrons, it is still common practice to eat somewhere outside of the restaurant, such as in a motor vehicle, be it in the parking lot or while en route to a particular destination. As such, these patrons do not eat in the restaurant at a dining table, but rather confine their eating to the inside of a motor vehicle. Consequently, one who attempts to simultaneously drive the motor vehicle and eat faces the challenge of having only one free hand with which to eat his/her fast food. Under such circumstances, it is quite difficult to perform otherwise-simple activities, such as dipping food pieces into condiments and safely operating a motor vehicle.

Equally, at sports and entertainment events, in public places such as stadiums or movie theaters, people may purchase fast food (e.g., hot dogs and French fries) at the concession stand and then bring their food to the stadium-style or theater-style seating, which is often less than spacious and with no table or other area to place the food. Similar to eating in a motor vehicle, an individual may have to balance the food on their lap in a box or other container and attempt to juggle a beverage and hot dog, for instance, while trying to dip their French fries in a packet of ketchup.

Additionally, due to the versatility of plastic materials, many businesses and packaging manufacturers are employing flexible plastics to make these packages. Such packages have the advantage of being workable and shaped to accommodate a user's short-term needs. However, flexible packages employed in the manners described above typically have a shortfall of not remaining in the desired open position without the user having to exert a continuous force on the flexible package to shape it as desired. In the case of a flexible package holding ketchup, for instance, a user may hold open the top portion of the flexible package and remove some of the ketchup, but the moment the user removes the force from this package, it returns to its original equilibrium position, typically a closed or semi-closed position, the contents of which are then not easily accessible to the user.

There are no known efforts at solving these problems with flexible packages. Thus, there is a need for an improved flexible package for use on the go, eating in motor vehicles, eating at stadium-style or theatre-style seating, and the like, and method thereof.

SUMMARY

In accordance with one embodiment of the present invention, a package system comprises: a flexible package having at least a front wall, a back wall, a top wall, a bottom wall, and a plurality of side walls; and a locking means disposed around at least a portion of the flexible package, the locking means comprising at least a semi-rigid member; wherein one of the front wall, the back wall, the top wall, the bottom wall, or any of the plurality of side walls has a substantially negligible surface area.

In accordance with another embodiment of the present invention, a package system comprises: a flexible package having at least a front wall, a back wall, a top wall, a bottom wall, and a plurality of side walls; a first semi-rigid member disposed on the front wall of the flexible package and comprising at least a female portion; and a second semi-rigid member disposed on the back wall of the flexible material and comprising at least a male portion; wherein one of the front wall, the back wall, the top wall, the bottom wall, or any of the plurality of side walls has a substantially negligible surface area.

In accordance with yet another embodiment of the present invention, a method for retaining a flexible package in an open position comprises: providing a package system having a flexible package with at least a front wall, a back wall, a top wall, a bottom wall, and a plurality of side walls, and a locking means disposed around at least a portion of the flexible package, the locking means comprising at least a semi-rigid member, wherein one of the front wall, the back wall, the top wall, the bottom wall, or any of the plurality of side walls has a substantially negligible surface area; causing an aperture to be formed in at least a portion of at least one wall of the flexible package; and engaging the locking means to place and retain the flexible package in an open position.

BRIEF DESCRIPTION OF THE DRAWINGS

So the manner in which the above-recited features of the present invention can be understood in detail, a more particular description of embodiments of the present invention, briefly summarized above, may be had by reference to embodiments, one of which is illustrated in the appended drawings. The appended drawings illustrate only typical embodiments of embodiments encompassed within the scope of the present invention, and, therefore, are not to be considered limiting, for the present invention may admit to other equally effective embodiments.

Figure 1:
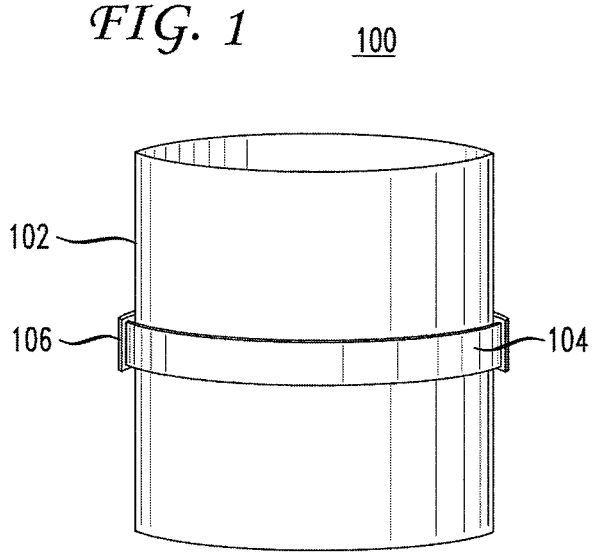
FIG. 1 depicts a perspective view of a flexible package system having a locking means in accordance with an embodiment of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

DETAILED DESCRIPTION

Embodiments of the present invention relate to an improved flexible package comprising a locking means for retaining the package in a substantially open position and method thereof.

As depicted in FIG. 1, a package system 100 in accordance with embodiments of the present invention comprises a flexible package 102. In accordance with one embodiment of the present invention, such a flexible package 102 may be of the type typically employed by fast food restaurants, stadium concession stands, or other food service institutions to dispense foodstuff such as condiments like ketchup, mustard, mayonnaise, relish, tartar sauce, etc. The flexible package 102 may comprise a packet, sachet, or any other reusable or disposable single- or multi-use medium feasible in the context of the present invention, and the flexible package 102 may be accessible from the top portion of the flexible package 102. In accordance with embodiments of the present invention, at least one wall of the package system 100 has a substantially negligible surface area.

Additionally, in accordance with one embodiment of the present invention, the flexible package 102 may additionally be used in the manner of a conventional liquid container. Access from the top of the flexible package 102 may allow for a liquid to be removed from the interior confines of the flexible package 102 in the manner of a conventional disposable juice or potable liquid container.

In accordance with one embodiment of the present invention, the package system 100 comprises a locking means. As used herein, the term "lock," and derivative terms thereof, refers to a structure that can be held in place by friction, adhesion or other forces feasible in the context of the present invention. The term "lock," and derivative terms thereof, may also refer to the engagement of a structure comprising more than one distinct portion being held in place by friction, adhesion, or any other forces feasible in the context of the present invention.

Figure 2:
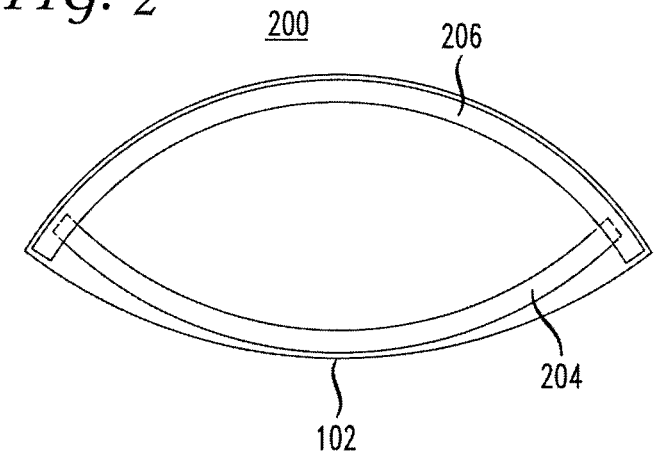
FIG. 2 depicts a top view of a flexible package system in accordance with another embodiment of the present invention.

The locking means may be disposed around at least a portion of the flexible package 102, and may comprise at least a semi-rigid member. In accordance with one embodiment of the present invention, the locking means may comprise at least a first semi-rigid member 106 and a second semi-rigid member 104. It should be understood the locking means may be disposed around an interior portion of the flexible package 102 (as shown in FIG. 2), an exterior portion of the flexible package 102, in a horizontal position, a vertical position, or any position in-between (i.e., at any angle relative to the flexible package), or any combination or variation thereof.

The locking means in accordance with this embodiment of the present invention may comprise any number of structures used for engaging and maintaining the flexible package 102 in a desired position or configuration. Such locking means may include, but not be limited to, at least one of a notch-and-tab lock, a friction fit lock, any equivalents thereof, and any combination thereof. Such a locking means may utilize a friction fit to hold the locking means in a desired position. The friction fit may comprise an interference fit or a transition fit. As used herein, the term "interference fit" and any derivative term thereof may refer to a fastening between components wherein the components are held in place by the force of friction alone and are tightly secured in that position. Additionally, as used herein, the term "transition fit" and any derivative term thereof may refer to a fastening between components, wherein the components are held in place by the force of friction alone and which is secured in the desired position, but remains able to be disassembled.

Figure 3A:
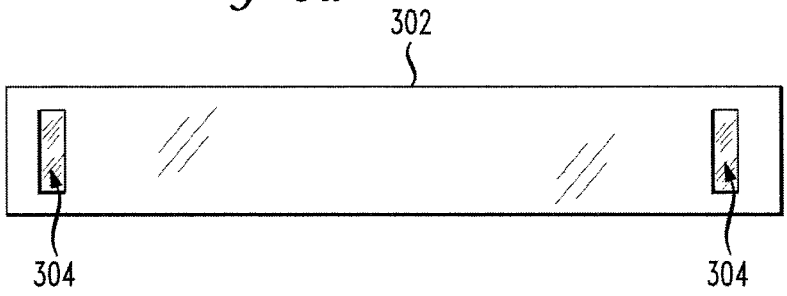
FIG. 3*a* depicts a front view of a first semi-rigid member of the locking means of FIG. 1 of the present invention.
Figure 3B:
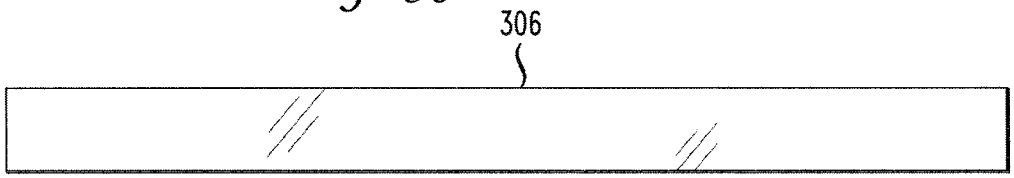
FIG. 3*b* depicts a front view of a second semi-rigid member of the locking means of FIG. 1, adapted and arranged to cooperate with the first semi-rigid member of FIG. 3*a;*

Referring now to FIGS. 3*a* and 3*b*, in accordance with one embodiment of the present invention, a locking means may comprise at least a first semi-rigid member 302 and a second semi-rigid member 306, wherein the at least first and second semi-rigid members are adapted and arranged to cooperate with each other. Specifically, the first semi-rigid member 302 may comprise at least a female portion 304, such as an indentation, or a plurality thereof. In accordance with another embodiment of the present invention, the second semi-rigid member 306 may comprise at least a male portion, which may or may not be visibly or physically delineated from the remainder of the second semi-rigid member 306.

In accordance with one embodiment of the present invention, one or more of the first semi-rigid member 302 or the second semi-rigid member 306 may comprise any semi-rigid material such as polymeric material. Such polymeric material may include, but is not limited to, high-density polyethylene, low-density polyethylene, polypropylene, polystyrene, polyethylene terephthalate, any other polymeric material feasible in the context of the present invention, or any combination thereof.

Figure 3C:
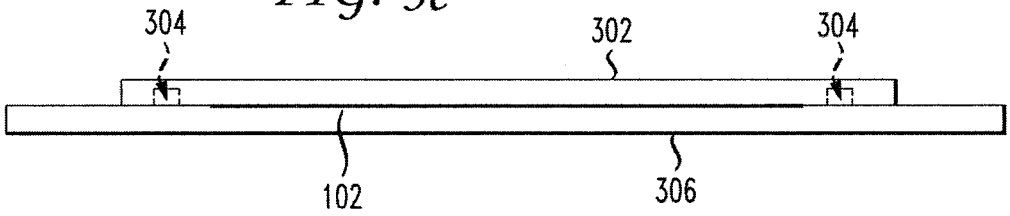
FIG. 3*c* depicts a top view of an unengaged locking means comprising the first and second semi-rigid members of FIGS. 3*a* and 3*b*, respectively, disposed on a closed flexible package.

As depicted in FIG. 3*c*, a locking mechanism such as that depicted in FIGS. 3*a* and 3*b* may be attached to a flexible package 102 in a closed position. In such a position, the flexible package 102 is closed and the components of the locking mechanism are not engaged. It should be understood that the locking means may be separate and distinct from the flexible package 102 or, alternatively, may be integral with the flexible package 102.

Figure 3D:
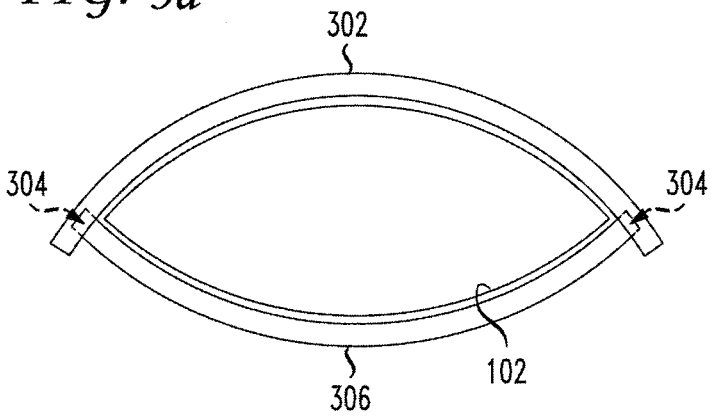
FIG. 3*d* depicts a top view of the locking means of FIG. 3*c* in operation, disposed on a substantially open flexible package.

As shown in FIG. 3*d*, in accordance with one embodiment of the present invention, in order to retain a flexible package 102 in an open position by utilizing such a locking means, a user inserts at least a male portion of the second semi-rigid member 306 into at least a female portion 304 of the first semi-rigid member 302. It should be noted that in an embodiment as depicted in FIG. 3*b*, the male portion comprises one or more ends of the second semi-rigid member 306. It is contemplated that at least one of the first semi-rigid member 302 and the second semi-rigid member 306 of the locking means each may contain male and/or female portions. The resulting coupling may be releasable—that is, the first semi-rigid member 302 and the second semi-rigid member 306 may be disengaged and remain intact—or may be permanent. In accordance with an embodiment of the present invention, a flexible package 102 comprising a permanent, non-releasable coupling may be disposable.

Figure 4A:
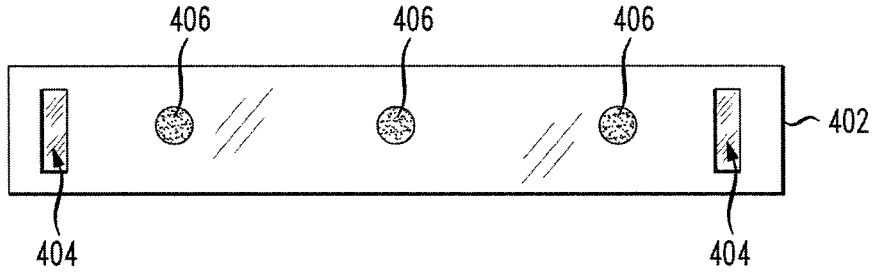
FIG. 4*a* depicts a front view of a first semi-rigid member in accordance with another embodiment of the present invention.
Figure 4B:
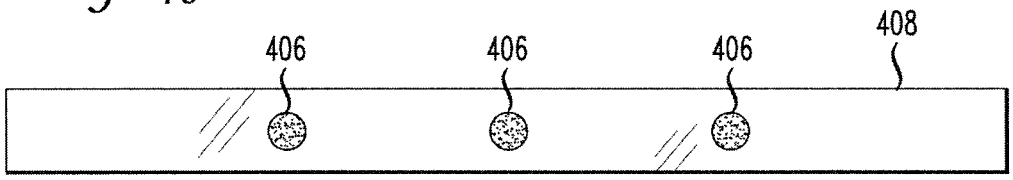
FIG. 4*b* depicts a front view of a second semi-rigid member adapted and arranged to cooperate with the first semi-rigid member of FIG. 4*a;*
Figure 4C:
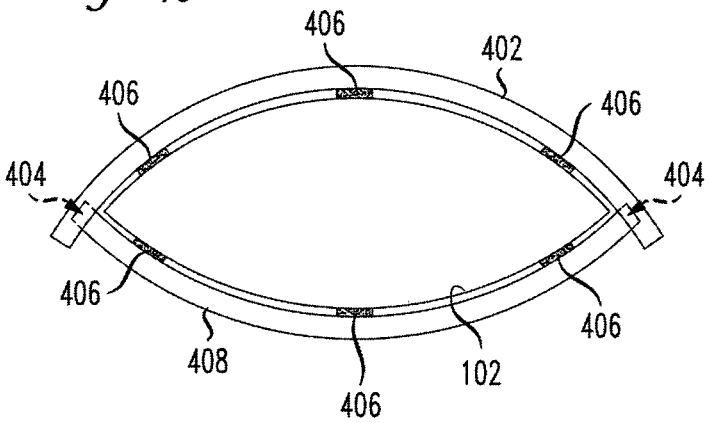
FIG. 4*c* depicts a top view of a locking means comprising the first and second semi-rigid members of FIGS. 4*a* and 4*b*, respectively, in operation and disposed on a substantially open flexible package.

As depicted in FIGS. 4*a*, 4*b*, and 4*c*, in accordance with another embodiment of the present invention, an adhesive composition 406 may be disposed on at least a semi-rigid member to adhere the adhesive-containing semi-rigid member or members to one or more walls of the flexible package 102. Such an embodiment may allow for a transfer of force from one or more components of the locking means to one or more walls of the flexible package 102 by way of adhesive bonding. The adhesive composition 406 may be disposed on at least a portion of one or more of the semi-rigid members. It should be noted that an adhesive composition 406 may be applied to any locking means and/or any flexible package 102. The adhesive composition 406 may be any such type feasible in the context of the present invention.

Figure 5A:
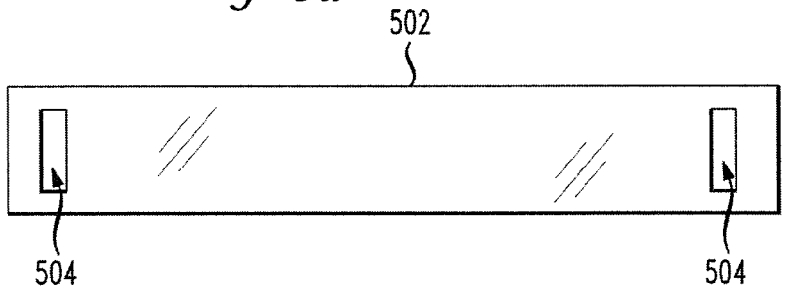
FIG. 5*a* depicts a front view of a first semi-rigid member in accordance with yet another embodiment of the present invention.
Figure 5B:
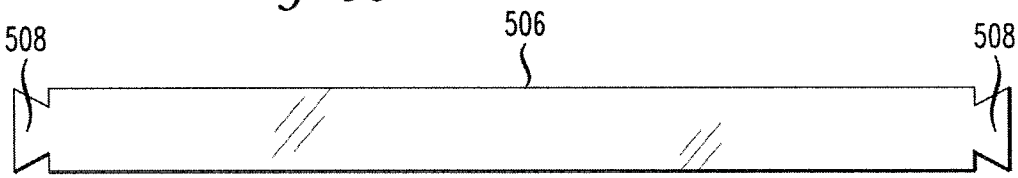
FIG. 5*b* depicts a front view of a second semi-rigid member adapted and arranged to cooperate with the first semi-rigid member of FIG. 5*a;*
Figure 5C:
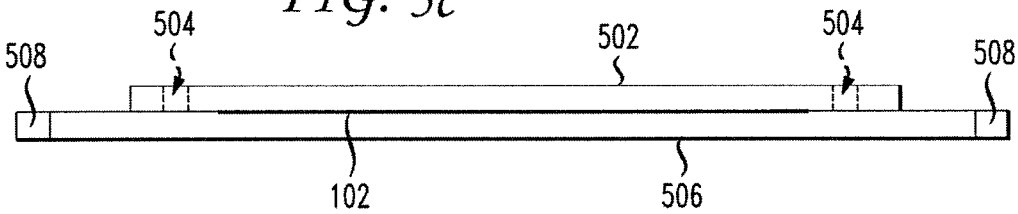
FIG. 5*c* depicts a top view of a locking means comprising the first and second semi-rigid members of FIGS. 5*a* and 5*b*, respectively, disposed on a closed flexible package.
Figure 5D:
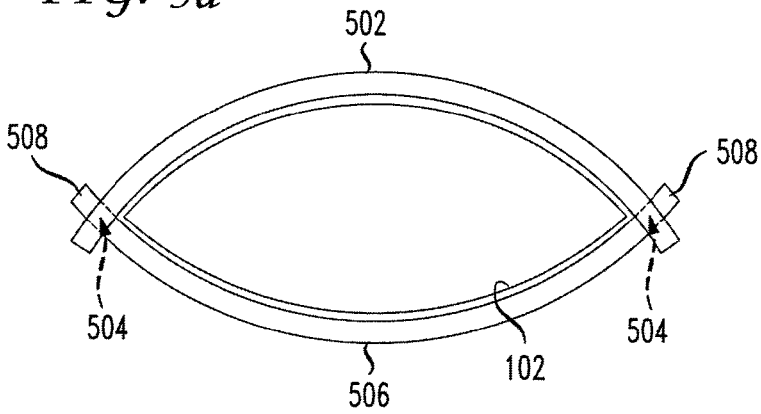
FIG. 5*d* depicts a top view of the locking means of FIG. 5*c* comprising the first and second semi-rigid members of FIGS. 5*a* and 5*b*, respectively, in operation, disposed on a substantially open flexible package.
Figure 6A:
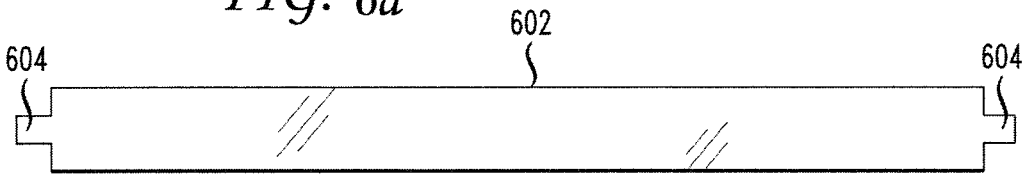
FIG. 6*a* depicts a front view of a second semi-rigid member in accordance with another embodiment of the present invention.
Figure 6B:
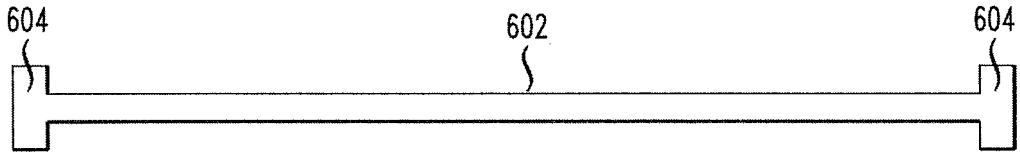
FIG. 6*b* depicts a top view of the second semi-rigid member of FIG. 6*a;*
Figure 6C:
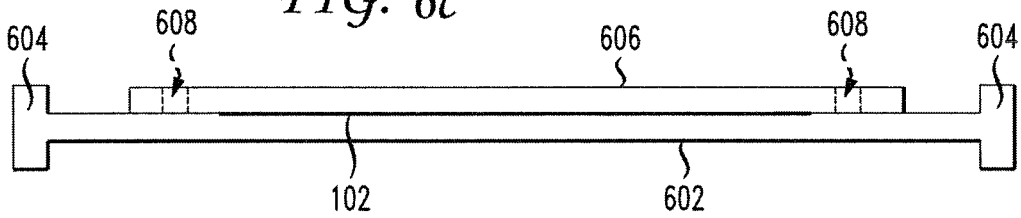
FIG. 6*c* depicts a top view of a locking means disposed on a closed flexible package in accordance with yet another embodiment of the present invention.
Figure 6D:
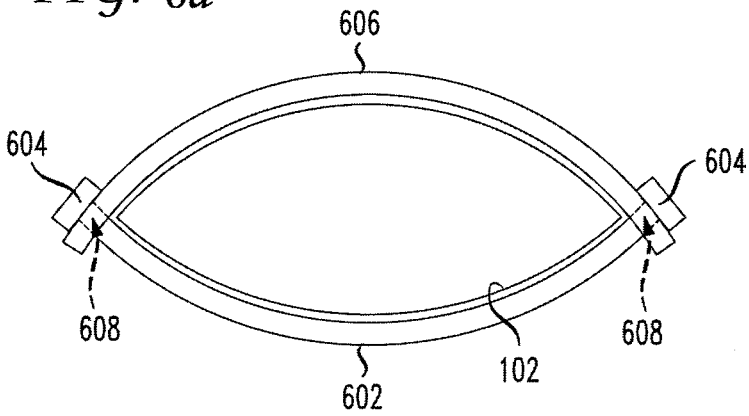
FIG. 6*d* depicts a top view of the locking means of FIG. 6*c* in operation disposed on an open flexible package.
Figure 7A:
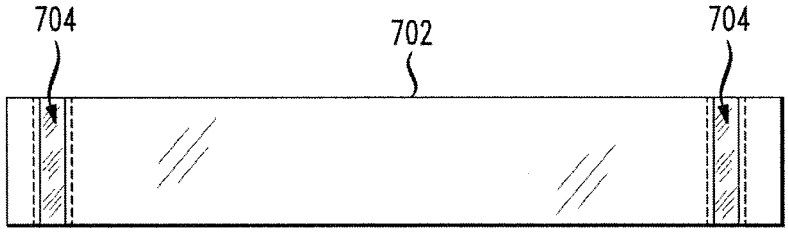
FIG. 7*a* depicts a front view of a first semi-rigid member in accordance with yet another embodiment of the present invention.
Figure 7B:
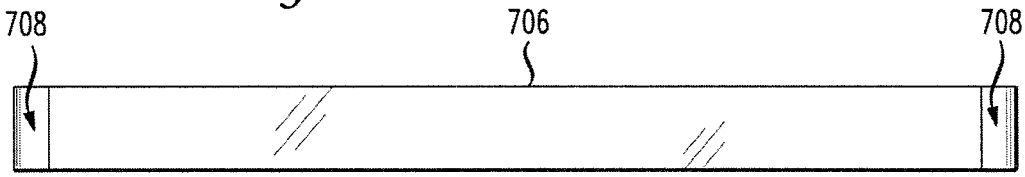
FIG. 7*b* depicts a front view of a second semi-rigid member adapted and arranged to cooperate with the first semi-rigid member of FIG. 7*a;*
Figure 8A:
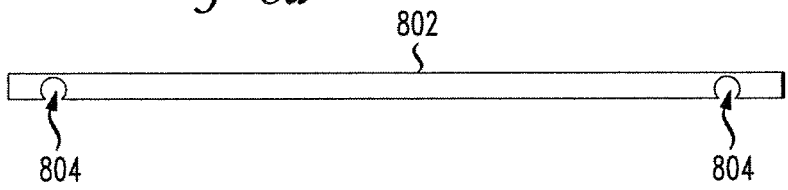
FIG. 8*a* depicts a top view of a first semi-rigid member in accordance with yet another embodiment of the present invention.
Figure 8B:
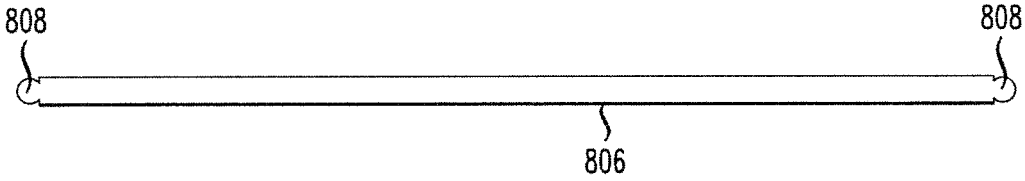
FIG. 8*b* depicts a top view of a second semi-rigid member adapted and arranged to cooperate with the first semi-rigid member of FIG. 8*a;*
Figure 8C:
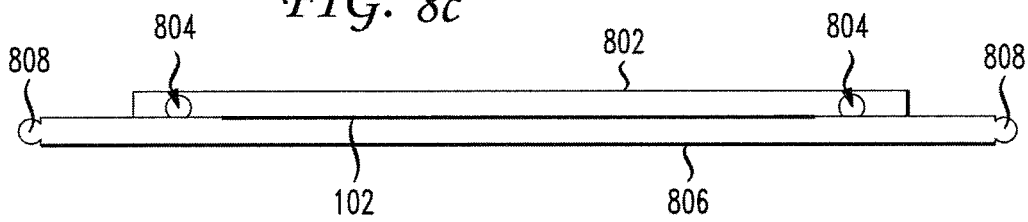
FIG. 8*c* depicts a top view of a locking means comprising the semi-rigid members of FIGS. 8*a* and 8*b*, respectively, disposed on a closed flexible package.
Figure 8D:
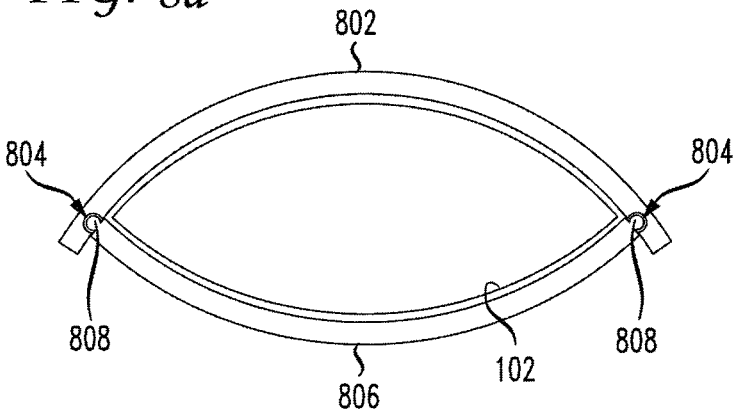
FIG. 8*d* depicts a top view of the locking means of FIG. 8*c* in operation disposed on an open flexible package.

Referring now to FIGS. 5*a*, 5*b*, and 5*c*, a first semi-rigid member 502 may comprise one or more female portions 504, such as holes, to receive one or more male portions 508, such as tabs, from a second semi-rigid member 506 in accordance with another embodiment of the present invention. In order to create an effective locking means, at least a portion of the tab or tabs may be larger in height than the hole or holes into which they fit. In such a circumstance, and as shown in FIG. 5*d*, the portions of the tab that extend beyond the boundaries of the hole will exert a counteracting force on portions of the first semi-rigid member 502, thus holding the first semi-rigid member 502 and the second semi-rigid member 506 in a locked fashion.

As depicted in FIGS. 6*a* through 6*d*, a second semi-rigid member 602 may comprise one or more tabs for engagement with a semi-rigid member comprising one or more holes, such as that depicted in FIG. 5*a*. In accordance with one embodiment of the present invention, at least a male portion 604 of the second semi-rigid member 602 may be disposed perpendicular to the remainder of the second semi-rigid member 602. In such an embodiment, the locking means may act in a similar fashion as that depicted in FIGS. 5*a*, 5*b*, and 5*c*, with differences including the configuration of the tab, and thus, the amount of and distribution of forces acting upon a first semi-rigid member when disposed in a locked and engaged position.

As depicted in FIGS. 7*a* through 7*d*, in accordance with yet another embodiment of the present invention, the locking means may comprise a first semi-rigid member 702 comprising at least a female portion 704, such as a notch, and a second semi-rigid member 706 comprising at least a male portion 708, such as a tab, similar to that depicted in FIGS. 3*a* through 3*d*.

As shown in FIGS. 8*a* through 8*d*, a notch of a first semi-rigid member 802 may take the shape of an arc containing a physical boundary extending around more than 180 degrees. In such an embodiment, a male portion 808 of a second semi-rigid member 806 may take a complementary shape. It should be noted, however, that the female portions 804 and male portions 808 of the semi-rigid members described herein are not limited to any particular shape or configuration, and may take any shape or configuration. Additionally, one or more female portions 804 and one or more male portions 808 of the semi-rigid members of the locking means need not be complementary—that is, any interlocking portions that may exert forces on each other in opposition to an applied force may be utilized in one or more embodiments of the present invention.

Figure 9A:
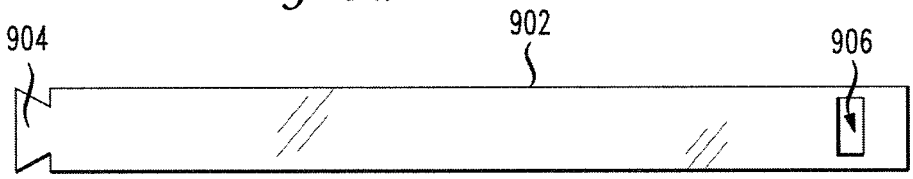
FIG. 9*a* depicts a front view of a semi-rigid member in accordance with yet another embodiment of the present invention.

As depicted in FIG. 9*a*, a locking means in accordance with yet another embodiment of the present invention may comprise at least one semi-rigid member 902 having at least a male portion 904 and at least a female portion 906. A male portion 904 and a female portion 906 of a semi-rigid member 902 in accordance with one embodiment of the present invention may be disposed on any area of the semi-rigid member 902. In such an embodiment, a male portion 904 and a female portion 906 of a semi-rigid member 902 may comprise any of the structures described hereinabove or any equivalents thereof.

Figure 9B:
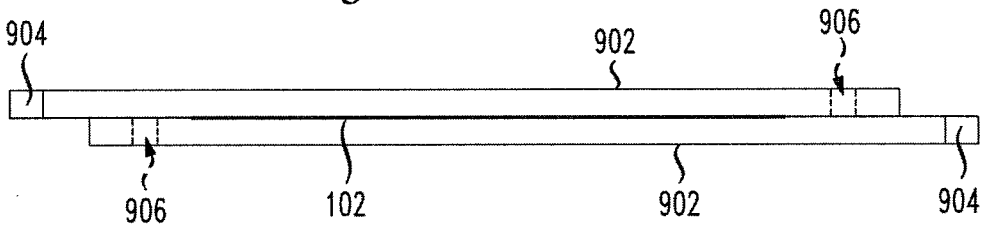
FIG. 9*b* depicts a top view of a locking means comprising the semi-rigid member of FIG. 9*a*, disposed on a closed flexible package.
Figure 9C:
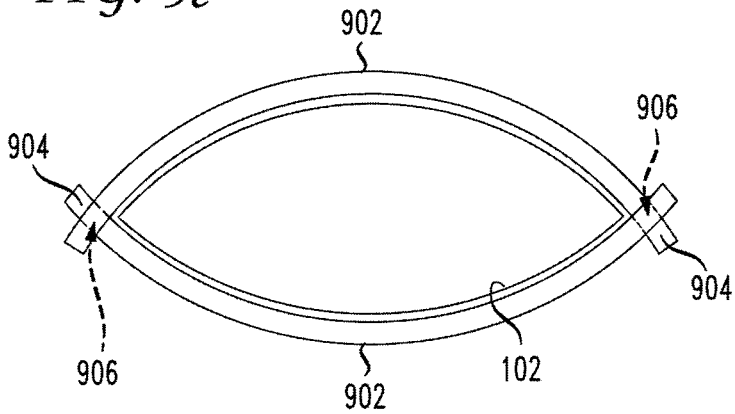
FIG. 9*c* depicts a top view of the locking means of FIG. 9*b* in operation and disposed on an open flexible package.

As depicted in FIGS. 9*b* and 9*c*, a plurality of semi-rigid members 902 comprising at least a male portion 904 and a female portion 906 may be utilized to create a locking means in accordance with one embodiment of the invention. In one such embodiment, one semi-rigid member 902 may be disposed on the front wall of the flexible package 102, and one semi-rigid member 902 may be disposed on the back wall of the flexible package 102. These two semi-rigid members 902 may be disposed in any fashion or configuration; as depicted in FIGS. 9*b* and 9*c*, in accordance with one embodiment of the present invention, the semi-rigid members 902 may be placed in a parallel but opposite configuration—that is, when configured on the walls of the flexible package 102, a male portion 904 of one semi-rigid member 902 may be adjacent to or in a proximal relation with a female portion 906 of another semi-rigid member 902 and vice versa. Such a configuration may facilitate engagement of the plurality of semi-rigid members in operation.

Figure 10A:
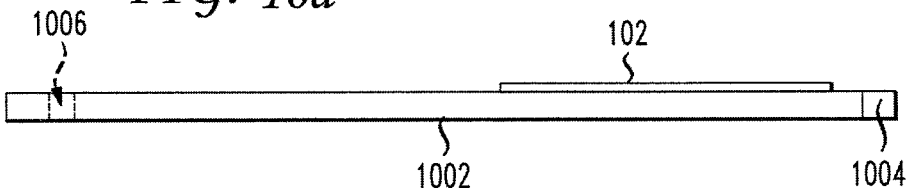
FIG. 10*a* depicts a top view of a locking means disposed on a closed flexible package in accordance with yet another embodiment of the present invention.
Figure 10B:
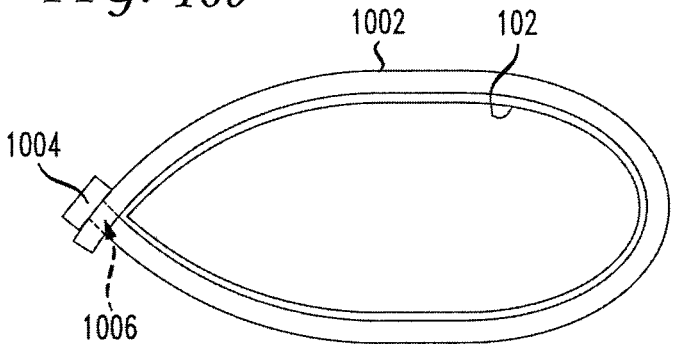
FIG. 10*b* depicts a top view of the locking means of FIG. 10*a* in operation disposed on an open flexible package.

As depicted in FIGS. 10*a* and 10*b*, in accordance with yet another embodiment of the present invention, a locking means may comprise a single semi-rigid member 1002 having at least a male portion 1004 and at least a female portion 1006. Such a locking means may be utilized in much the same fashion as the locking means depicted in FIGS. 9*a* through 9*c*. When utilizing only a single semi-rigid member 1002 having at least a male portion 1004 and at least a female portion 1006, the entirety of the semi-rigid member 1002 may be disposed around the flexible package 102. Prior to engagement of the locking means, the semi-rigid member 1002 may be configured such that a male portion 1004 of the semi-rigid member 1002 is disposed adjacent to or in a proximal relation with a female portion 1006 of the semi-rigid member 1002.

Embodiments of the present invention such as those described in the previous paragraphs and as depicted in FIGS. 9*a* through 10*b* alleviate the need for two or more separate and distinct components, each of which may require the other in order to carry out its intended function. Furthermore, such embodiments may result in lower manufacturing costs and greater simplicity of design and manufacture.

Figure 11:
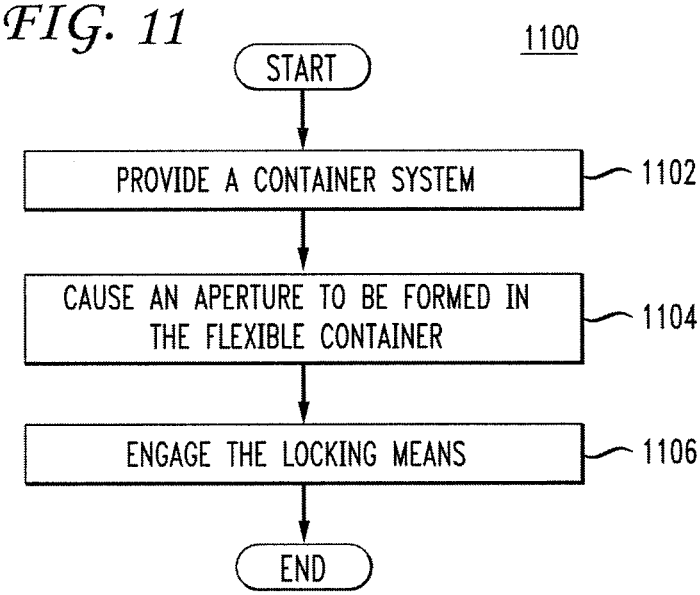
FIG. 11 is a flowchart of a method for retaining a flexible package in an open position in accordance with another embodiment of the present invention.

A method 1100 for retaining a flexible package in an open position is depicted in FIG. 11 in accordance with one embodiment of the present invention. In operation, a flexible package system as described herein is provided at step 1102. The user may then cause an aperture to be formed in at least a portion of at least one wall of the flexible package in step 1104. This may be achieved in any number of ways, including but not limited to tearing at least a portion of one or more walls of the flexible package in order to expose the inner contents of the flexible package. In accordance with one embodiment of the present invention, the flexible package must be opened via tearing (or otherwise) the wall of the flexible package having a negligible surface area; that is, the aperture must be formed in the wall having a negligible surface area.

Once an aperture is formed in the flexible package, a locking means in accordance with one or more embodiments as disclosed and described herein may be engaged in step 1106. The engagement of the locking means serves to increase the area of the aperture and lock the flexible package in the desired position, thus retaining the flexible package in a substantially open position to provide simplicity of access to the inner contents.

In accordance with one embodiment of the present invention, a locking means may be releasably engageable, permanently engageable, or any combination thereof. In an embodiment utilizing a releasably engageable locking means, the male portions and female portions of one or more semi-rigid members may be disengaged and reengaged at a later time. In an embodiment utilizing a permanently engageable locking means, the male portions and female portions of one or more semi-rigid members may be irreversibly engaged, in which case the package system may be disposable.

Furthermore, in accordance with another embodiment of the present invention, a flexible package using a releasably engageable or permanently engageable locking means may comprise a resealable fastening means disposed on at least one wall. The resealable fastening means may comprise one or more releasably interlocking components, which serve to seal the flexible package and which may be engaged or disengaged at any time in a manner that presents little or no threat to the structural integrity of the resealable fastening means itself, the flexible package, or any other structure herein described.

Figure 12:
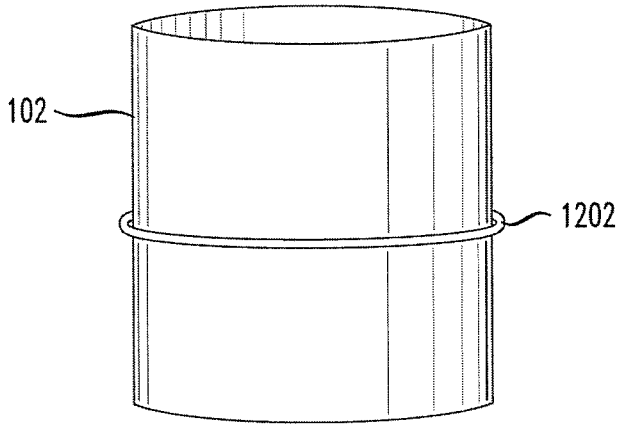
FIG. 12 depicts a front view of a locking means in operation disposed on an open flexible package in accordance with one embodiment of the present invention.

As depicted in FIG. 12, in accordance with yet another embodiment of the present invention, a flexible package 102 may be fit with a locking means such as a semi-rigid wire 1202. The wire 1202 may comprise metal, a polymeric material, paper, any other material feasible in the context of the present invention, or any combination thereof, to facilitate flexible package to retain at least one substantially open end for allowing access to the contents of the flexible package. The wire 1202 may be bare or may be encased in another material, such as paper or plastic.

In operation, a wire 1202 may be disposed around a flexible package 102 and may be retained in a desired position. For example, one or more portions of the wire 1202 may be twisted in the manner of a conventional twist tie. In such a manner, the wire 1202 may hold its shape on the flexible package 102, mostly using the force of friction, and thus be operable to maintain the flexible package 102 in a desired position.

Figure 13A:
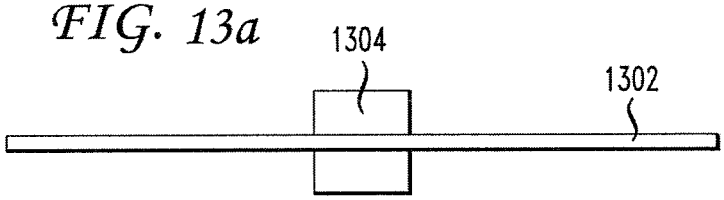
FIG. 13*a* depicts a front view of the locking means of FIG. 12 further comprising an adhesive pad in accordance with another embodiment of the present invention.
Figure 13B:
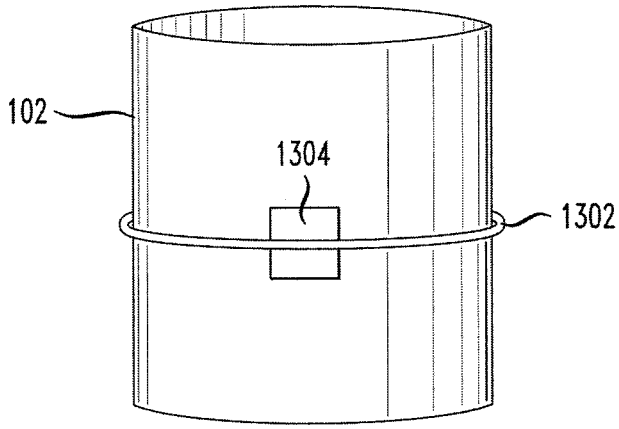
FIG. 13*b* depicts a front view of the locking means of FIG. 13*a* in operation, disposed on an open flexible package.

As depicted in FIGS. 13*a* and 13*b*, in accordance with one embodiment of the present invention, a wire 1302 may be attached to a flexible package 102, such as the flexible package 102 shown in FIG. 12, via an adhesive pad 1304. The adhesive pad 1304 may comprise at least a substrate and at least an adhesive composition disposed on at least a portion of at least a substrate. An adhesive pad 1304 may be attached to a flexible package 102 and to a wire 1302, thus adhering the two together. The adhesive pad 1304 may additionally comprise a removable sheet that prevents the adhesive pad 1304 from adhering to any object or material during transportation, and allows the user to designate and control the adhesion of the adhesive pad 1304 to an object.

In accordance with one embodiment of the present invention, the removable sheet may comprise a polymeric material that is cleanly removable from the adhesive pad 1304—that is, when removed from the adhesive pad 1304, the removable sheet removes a negligible amount of an adhesive composition from the adhesive pad 1304. In operation, as depicted in FIG. 13*b*, the adhesive pad 1304 serves the purpose of maintaining the wire 1302 in connection with the flexible package 102, which may become quite important during packaging and shipping of such an embodiment of the present invention.

Figure 14A:
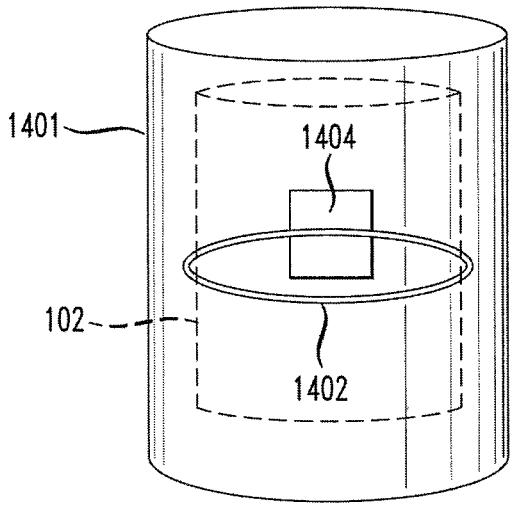
FIG. 14*a* depicts a front view of the locking means of FIG. 13*a* attached to an open package via an adhesive pad, in operation in accordance with yet another embodiment of the present invention.
Figure 14B:
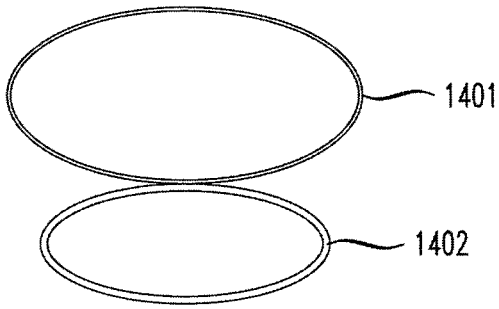
FIG. 14*b* depicts a top view of the locking means of FIG. 13*a* attached to the open package of FIG. 14*a* via an adhesive pad in operation.

As depicted in FIGS. 14*a* and 14*b*, in accordance with another embodiment of the present invention, a wire 1402 may be adhered to the exterior portion of an open container 1401 via an adhesive pad 1404. In this manner, an open container 1401 may be connected to a flexible package (shown by the dotted lines), which may be held in place by the wire 1402. For example, and in no way limiting in the scope of the present invention, in one embodiment, the open container 1401 may comprise an open foodstuff container for holding, e.g., French fries, onion rings, hot pretzel bites, etc. An additional advantage of such an embodiment relates to the ability of the wire 1402 to adapt to a flexible package having almost any shape. Also, flexible package disposed within the wire 1402 may be interchangeable; that is, a flexible package may be placed inside the wire 1402 and removed from the grasp of the wire 1402, and a second flexible package may be placed therein and the wire 1402 reshaped to adapt to the shape of the new flexible package.

Figure 15:
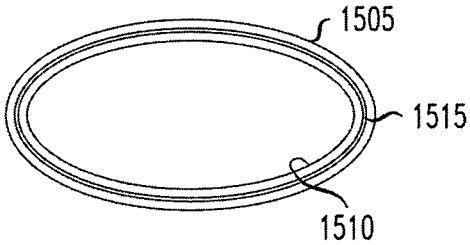
FIG. 15 depicts a top view of a locking means disposed within a plurality of foil layers in accordance with yet another embodiment of the present invention.

As depicted in FIG. 15, an apparatus 1500 may comprise a locking means disposed on a flexible package wherein the flexible package may comprise a plurality of foil layers 1505, 1510 in accordance with one embodiment of the present invention. A wire 1515 may be disposed between two foil layers 1505, 1510, thus being enclosed within the walls of the flexible package. In such an embodiment, the wire 1515 will not be in contact with either the exterior portion of the flexible package or the interior portion of the flexible package. In this manner, the wire 1515 will be isolated from contact with any foodstuff or portion thereof. It should also be noted the flexible package may comprise any number of foil layers, and a foil layer may comprise a polymeric material, a metal, paper, or any combination thereof, and may include but should not be limited to the traditional (metal) definition of the term.

Figure 16:
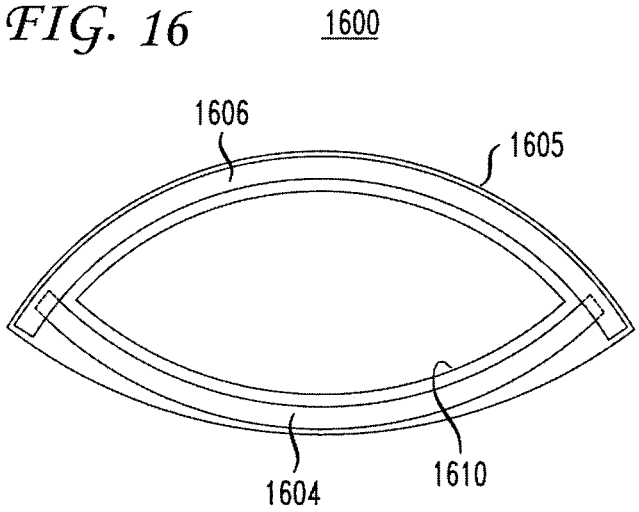
FIG. 16 depicts a top view of a plurality of semi-rigid members in a locked position disposed within a plurality of foil layers in accordance with yet another embodiment of the present invention.

As depicted in FIG. 16, a flexible package comprises foil layers 1605, 1610, similar to that flexible package portrayed in FIG. 15. A first semi-rigid member 1606 comprising at least a female portion is engaged in a locked position with a second semi-rigid member 1604 comprising at least a male portion. In accordance with one embodiment of the present invention, each of the first semi-rigid member 1606 and the second semi-rigid member 1604 is disposed between a plurality of foil layers 1605, 1610. In this manner, as the embodiment depicted in FIG. 15, neither of the first semi-rigid member 1606 and the second semi-rigid member 1604 will come into contact with any foodstuff contained within the flexible package or any portion thereof. It should be noted that any of the locking means and/or structures described herein may be utilized in accordance with such an embodiment of the present invention.

Figure 17:
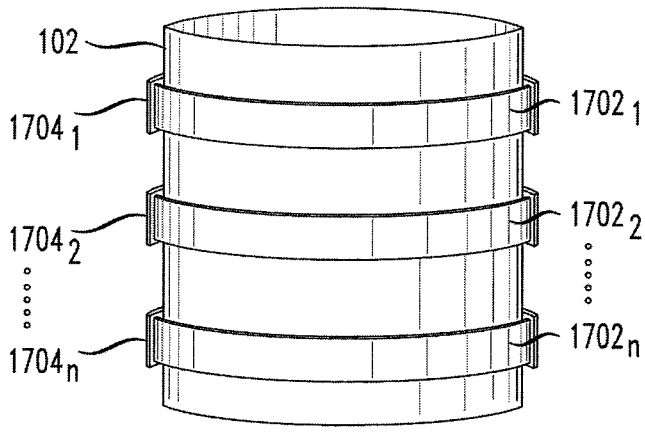
FIG. 17 depicts a front view of a plurality of semi-rigid members disposed around an open flexible package in operation in accordance with yet another embodiment of the present invention.

As depicted in FIG. 17, in accordance with yet another embodiment of the present invention, a plurality of locking means may be disposed around a flexible package 102. In accordance with one embodiment of the present invention, each of the locking means comprises at least a first semi-rigid member (shown as $\mathbf{1704}_1$ through $\mathbf{1704}_n$) and a second semi-rigid member (shown as $\mathbf{1702}_1$ through $\mathbf{1702}_n$). It should be noted that any number of locking means may be utilized in connection with such an embodiment of the present invention. The locking means may be disposed around a flexible package 102 on the exterior portion of the flexible package 102, the interior portion of the flexible package 102, between foil layers of a flexible package 102, any other portion of the flexible package 102 feasible in the context of the present invention, or any combination thereof. It should also be noted that the locking means, either as one or as a plurality may be disposed around the flexible container 102 in any orientation, that is, parallel, perpendicular, angled or arbitrarily placed so long as when in operation, the one or plurality of locking means causes at least one side of the flexible package to have an aperture for at least temporarily accessing the contents of the flexible package.

While the foregoing is directed to embodiments of the present invention, other and further embodiments of the invention may be devised without departing from the basic scope thereof, and the scope thereof is determined by the claims that follow.

What is claimed is:

1. A package system comprising:

a flexible package having a plurality of walls;

a first semi-rigid member cooperating with the exterior of a front wall of the flexible package and comprising at least an aperture through the first semi-rigid member; and a second semi-rigid member cooperating with the exterior of a back wall of the flexible package and comprising at least a male portion projecting outwardly from a center of the second semi-rigid member and parallel to a longitudinal axis of the second semi-rigid member;

wherein the package system has a closed configuration in which the first and second semi-rigid members and at least a portion of the flexible package are substantially flat and the male portion is not engaged with the aperture, and wherein the package system has an open configuration in which the male portion is engaged with the aperture to maintain the flexible package in the open configuration.

2. The package system of claim 1, wherein at least one of the first semi-rigid member and the second semi-rigid member comprises a polymeric material.

3. The package system of claim 1, wherein at least one of the first semi-rigid member and the second semi-rigid member comprises at least a male portion and an aperture.

4. The package system of claim 1, further comprising an adhesive composition for adhering at least one of the first semi-rigid member and the second semi-rigid member to the flexible package.

5. The package system of claim 1, wherein at least a top wall of the flexible package is tearable.

6. The package system of claim 1, further comprising a resealable fastening means disposed on at least one wall.

7. A package system comprising:

a flexible package having at least first and second walls;

a first semi-rigid member cooperating with the first wall and comprising first and second apertures associated with respective first and second ends of the first semi-rigid member; and a second semi-rigid member cooperating with the second wall of the flexible package and comprising first and second male portions associated with respective first and second ends of the second semi-rigid member;

wherein the package system has a closed configuration in which the first and second semi-rigid members and at least a portion of the flexible package are substantially flat and the first and second male portions are not engaged with the first and second apertures, respectively, and wherein the package system has an open configuration in which the first and second male portions are engaged with the first and second apertures to maintain the flexible package in an open position.

8. The package system of claim 7, wherein the first and second apertures are each positioned a distance inward from respective distal ends of the first semi-rigid member.

9. The package system of claim 7, wherein the first and second male portions each comprise a portion disposed perpendicular to a longitudinal axis of the second semi-rigid member.

10. The package system of claim 7, wherein the first and second male portions are greater in height than the first and second apertures, respectively.

11. The package system of claim 7, wherein when in the second configuration, portions of the first and second male portions that extend beyond the first and second apertures exert a counteractive force on portions of the first semi-rigid member to hold the flexible package in the open position.

12. The package system of claim 7, wherein the flexible package comprises a top portion, and the first and second semi-rigid members are engaged with the first and second walls below the top portion.

13. The package system of claim 12, wherein the top portion is tearable.

14. The package system of claim 7, wherein the first and second semi-rigid members are integral with the first and second walls of the flexible package.

15. A package system comprising:

a flexible package having a plurality of walls; and a locking apparatus configured to cooperate with at least the exterior portion of the flexible package, the locking apparatus comprising:

a first semi-rigid longitudinal member, comprising:

a first longitudinal end;

a second longitudinal end, disposed opposite from the first longitudinal end;

a longitudinal axis extending from the first longitudinal end to the second longitudinal end;

a first aperture through the first semi-rigid longitudinal member and adjacent to the first longitudinal end; and a second aperture through the first semi-rigid longitudinal member and adjacent to the second longitudinal end;

a second semi-rigid longitudinal member, comprising:

a first longitudinal end;

a second longitudinal end, disposed opposite from the first longitudinal end; and a longitudinal axis extending from the first longitudinal end to the second longitudinal end, wherein the first longitudinal end of the second semi-rigid longitudinal member comprises a first male portion projecting parallel to the longitudinal axis, and the second longitudinal end of the second semi-rigid longitudinal member comprises a second a male portion projecting parallel to the longitudinal axis, wherein:

the first male portion projects away from the second male portion, and the second male portion projects away from the first male portion;

wherein the locking apparatus has a first configuration in which the first and second semi-rigid longitudinal members and at least a portion of the flexible package are substantially flat and the first and second male portions are not engaged with the first and second apertures, and wherein the locking apparatus has a second configuration in which the first and second male portions are engaged with the first and second apertures, respectively, to maintain the flexible package in an open position.

16. The package system of claim 15, wherein the locking apparatus comprises at least one of an interference fit or a transition fit.

17. The package system of claim 15, further comprising an adhesive composition for adhering at least a portion of the locking apparatus to at least one of said plurality of walls.

18. The package system of claim 15, wherein the at least one semi-rigid member comprises a polymeric material.

19. The package system of claim 15, wherein the at least one semi-rigid member of the locking apparatus comprises at least a male portion and a female portion.

20. The package system of claim 15, wherein:

the first aperture is characterized by an aperture size in a predetermined direction; and the first male portion comprises a tip region characterized by a tip size in the predetermined direction, wherein the tip size is greater than the aperture size in the predetermined direction.

* * * * *